US005993915A

United States Patent [19]

Krebsbach

[11] Patent Number: 5,993,915

[45] Date of Patent: Nov. 30, 1999

[54] FUSING THERMAL SPRAY COATING AND HEAT TREATING BASE MATERIAL USING INFRARED HEATING

[75] Inventor: John D. Krebsbach, Waunakee, Wis.

[73] Assignee: Adaptive Coating Technologies, LLC, Waunakee, Wis.

[21] Appl. No.: 08/911,006

[22] Filed: Aug. 14, 1997

[51] Int. Cl.[6] ..... B05D 3/06

[52] U.S. Cl. ..... 427/452; 427/557; 427/559; 427/455; 427/456

[58] Field of Search ..... 427/455, 456, 427/452, 557, 559

[56] References Cited

U.S. PATENT DOCUMENTS

| | | | |
|---|---|---|---|
| 3,079,275 | 2/1963 | Holowaty | 427/557 |
| 3,400,010 | 9/1968 | Keating | 427/557 |
| 5,268,045 | 12/1993 | Clare | 148/518 |
| 5,391,408 | 2/1995 | Piera | 427/542 |
| 5,455,079 | 10/1995 | Oden et al. | 427/450 |

OTHER PUBLICATIONS

"Brazing" by Mel M. Schwartz, ASM International 1987 (no month date).

*Primary Examiner*—Katherine A. Bareford
*Attorney, Agent, or Firm*—Donald Cayen

[57] ABSTRACT

A method of fusing a thermal spray coating to a base material employs infrared heating. The thermal spray coating is applied to the base material in a conventional manner. The infrared heater applies unidirectional heat in a first time-temperature relation to the coating during a fusing phase to melt individual coating platelets into a dense layer and to metallurgically bond the coating to the base material. In a base material that is heat treatable, the base material can be heat treated subsequent to the fusing phase. Initial heat treating of the base material occurs during the fusing phase. Continued heat treating of the base material is achieved after the thermal spray coating fusing phase by a second application of time-temperature from the infrared heater. A cold wall process can be used to aid in the quenching phase of the heat treating process. A second infrared heater can be employed to fuse and bond a second thermal spray coating on the base material and also to contribute to the heat treating of the base material.

20 Claims, 14 Drawing Sheets

FUSING THERMAL SPRAY COATING AND HEAT TREATING BASE MATERIAL USING INFRARED HEATING

1. BACKGROUND OF THE INVENTION

This invention pertains to altering the properties of composite materials, and more particularly to processes for fusing coatings on a base material and optionally heat treating the base material.

2. DESCRIPTION OF THE PRIOR ART

It is well known to deposit a coating onto a surface of a base material in order to improve the properties of the base material. For example, the hardness and wear resistance of a metal component can be enhanced by coating it with a thermal spray coating. Products made from thermal spray coated materials find a wide variety of applications. Typical applications include augers, sickles, and other blades and knives on agricultural implements; plungers, hydraulic rams, shafts, and impellers on pump products; and similar wear prone components in the mining, oil, and automotive industries.

Thermal spray processes include combustion (fuel-oxygen), electric arc, plasma, and high velocity oxygen fuel (HVOF). Electric arc processes use wire for the thermal spray raw material. Combustion processes use either wire or powder. Other processes use raw materials only in powder form. The raw materials are deposited on the base material using known thermal spray processes and equipment. The thermal spray coating may be deposited on more than one surface of the base material. The sprayed particles reach the base material in a molten or semi-molten state. The heated particles strike the base material and each other at high speed. The particles flatten and form thin platelets that conform and adhere to the base material and to each other. As the particles impinge on the base material and each other, they cool and build up, particle by particle, into a lamellar structure, thus creating a coating. Thermal spray coatings are typically 0.002 or more inches thick.

Although prior thermal spray coated parts have gained widespread acceptance for numerous applications, they nevertheless possess a few features that are undesirable in certain instances. For instance, thermal spray coatings are porous. Consequently, moisture or other corrosive fluids can seep through the interstices between adjacent platelets and corrode or attack the base material. Since most thermal spray coatings have adhesive bond strengths less than 10,000 psi and are mechanically bonded to the base material, impact strength is generally low. In severe sliding wear applications, particle pullout is also a common problem due to low cohesive strength, and coating delamination is the result of low adhesive strength. High adhesive and cohesive strengths are required for severe applications such as agricultural and pump products, which are subject to high impact loads, temperatures, and velocities, and also possibly to corrosive, abrasive, and/or erosive wear environments. Therefore, for many applications it is highly desirable that the strengths of the thermal spray coating be improved. Improving the cohesive and adhesive strength of the coating should or generally increases its wear and impact properties. Also, decreasing the porosity of the coating should or generally increases its corrosion properties, depending on the corrosive media, time, concentration, coating composition, etc.

FIG. 1A is a photomicrograph of the interface between a typical prior thermal spray coating 2 and a stainless steel base material 4. The magnification is 125×. The defects of the as-sprayed thermal spray coating 2 are readily apparent. They include a partial delamination/debonding at the interface 6 between the thermal spray coating and the base material 4. The black spherical areas are generally particle pullout, which can be caused by mechanical preparation processes such as polishing and grinding. Porosity is indicated by other black areas 31 that occur during spraying. The black areas 30 at the interface 6 are usually entrapped grit media. Particle pullout can also be experienced by products subjected to sliding, abrasive, or erosive wear applications. FIG. 1B is a photomicrograph at 500× magnification of the thermal spray coating. Undesirable globular particles 33 and porosities 31 are readily seen. Pullout of the globular particles 33 create the spherical particle pullouts that are noticeable in FIG. 1A.

It is frequently advantageous to modify the properties of the thermal spray coating and the base material after coating. A typical example is melting or fusing the thermal spray coating, and heat treating the underlying base material to which the thermal spray coating has been applied. It is common to fuse a thermal spray coating to the base material. Typical coating fusion processes include torch fusing, furnace fusing, and induction fusing. However, reliable fusing was difficult to achieve using the prior equipment and processes.

Fusing a thermal spray coating and heat treating the underlying base material is rarely, if ever, done. Prior processes potentially suitable for heat treating the base material of thermal sprayed parts include induction hardening, flame hardening, electron beam heat treating, and laser hardening. Each has important disadvantages. Induction hardening, for example, is generally limited to processing flat or round shapes. Especially in large plates, induction hardening produces uneven expansion and contraction of the coating and base material, or unwanted thermal stress within the material. The more modern methods of electron beam and laser hardening require expensive set-up costs and processing equipment (i.e., programming point-to-point, robotic equipment, and possible vacuum requirements) and are limited to processing only one part at a time. Both fusing thermal spray coatings and heat treating the base material using electron beam or laser would be very difficult, and even if possible would have limited applications. For example, hardness depths of the base material using laser hardening is limited to only about 0.10 inches. Other problems associated with prior processes, such as induction and flame processes, include overheating of the coating causing delamination, excessive alloying, and limited heat treat depths. In general, the prior fusing and heat treating processes either lacked repeatability due to manual procedures and process variables, or were generally not economical processes, often because the limited part quantities or the product market did not justify the capital and operating costs incurred. Consequently, prior thermal spray coated fused and heat treated parts were unsatisfactory, and even those parts were expensive to produce.

Thus, a need exists for improvements in the manufacture of thermal spray coated parts.

SUMMARY OF THE INVENTION

In accordance with the present invention, methods and apparatus are provided for fusing a thermal spray coating to a base material, and optionally simultaneously heat treating the base material and continuing to heat treat the base material after fusing is completed. This is accomplished by applying the correct amount of electromagnetic energy on selected part surfaces for the correct amount of time to the thermal spray coating and the base material.

The methods of the invention are preferably carried out using a high intensity short wave infrared radiant heater. The infrared heater contains at least one tungsten filament quartz tube lamp that is properly oriented relative to the part. The infrared heater may be oriented in a plane that is parallel to a surface of a part. The invention is also suitable for use with parts having complex shapes and non-planar surfaces that have thermal spray coatings. The infrared heater can be stationary relative to the part, the heater can be made to translate across the part surface, or the part can translate past the heater. In all cases, the part absorbs the radiation wave length to heat the coating surface.

By applying different energy levels, and holding times from the infrared heater directed toward a thermal sprayed part, several different results can be obtained. One result is the collapse of the porous regions between the platelets of the thermal spray coating to produce a more impermeable barrier than is obtained with an as-sprayed coating. That is achieved by providing a time-temperature characteristic suitable to the particular thermal spray coating material, such that the thermal spray coating material platelets melt and flow to fill voids in the coating and eliminate all interparticle boundaries. Atomic diffusion occurs creating a more chemically and physically homogeneous structure. The altered thermal spray coating inherently provides a superior coating in service by having increased cohesive strength, density, and enhanced ability to withstand wear, corrosive impact, loading, and temperature environments.

Another highly beneficial result of properly heating a thermal spray coating is that the coating becomes fused to the base material. The adhesion of the thermal spray coating to the base material is then due to metallurgical bonding, which is superior to the prior mechanical bonding with an as-sprayed coating. This greatly improves coating toughness since coating failure will generally cause delamination of the coating at the bond interface upon sufficient impact.

The process of the invention is also capable of heat treating a heat treatable base material in a fully controlled fashion. At least a portion of the heat treating cycle can be carried out during the fusing cycle. As an illustration, the surface of a steel base material under a thermal spray coating can be hardened to a desired depth and hardness while leaving some of the base material softer or more ductile.

The resulting product having a homogeneous coating microstructure (chemistry, porosity, surface finish, hardness), high adhesive bond strength, and deep base material hardening can be produced more economically than products produced using traditional fusing and heat treating methods. In addition, the coating is able to resist more stress than an as-sprayed coating. The invention also minimizes cracking, sagging, and warpage experienced when using other fusing technologies. Consequently, the products produced by the invention also have high wear and impact resistance.

To achieve the beneficial results of the invention, a thermal spray coated part may be placed in an infrared furnace. Alternately, the part may be placed relative to the infrared heater such that no walls or partitions separate the part and the infrared heater from the ambient atmosphere. In either case, the infrared heater is arranged and located at a correct distance from the part. The heater is energized in a rapid and controlled manner to heat the thermal spray coating to the desired temperature. The time for which the infrared heater remains energized is also controlled for a desired fusing cycle. After the thermal spray coating has been properly processed, the part can be cooled immediately. On the other hand, if the base material is to be heat treated, the heat treating can begin during the fusing phase, and the part is not cooled after the fusing cycle. Rather, the infrared heater is controlled in a second time-temperature cycle so as to complete heat treating of the base material in the desired way. Thereafter, the entire part is cooled.

Further in accordance with the present invention, the fusing and heat treating processes of the composite part may utilize the cold wall process. The cold wall process produces a controlled temperature difference between the hotter coating/base material and the cooler ambient air or walls inside the infrared furnace. The temperature differential produces a natural convective quenching of the composite material. Other quenching methods may be utilized including conductive cooling using a heat sink in contact with the coating/base material. This conductive cooling method can be utilized to establish and maintain a thermal gradient throughout the fusing/heating treating process. The cold wall process aids in quenching the base material after the fusing and heat treating cycles, thereby aiding in controlling the microstructure of the coating and the base material.

In some instances, it is desirable to case harden the base material surface opposite the surface that is thermal spray coated. In other instances, it may be desirable to heat treat the entire base material. The flexibility of the present invention enables those results to be accomplished without difficulty.

To decrease the total through-hardening time to heat treat the base material on the surface thereof opposite a thermal spray coating, a second infrared heater may be located at a selected distance from that surface. Depending upon the base material, the second heater can produce through hardening. With a heater directed toward a steel material surface, infrared heating will produce the highest hardness on the material surface with a gradual reduction in hardness as a function of depth. With two infrared heaters directed toward opposite steel material surfaces, infrared heat treating will produce the highest hardness on both material surfaces that decrease as a function of depth from the surface. Two infrared heaters are used if the thermal spray coating is applied to both material surfaces. The infrared heaters can be oriented in one plane for heating flat surfaces, located circumferentially for heating cylindrical objects, or in a more complex array for heating a complex part configuration. A circumferential arrangement can also be used to heat flat parts. Different heating rates for different heaters may be used to control thermal expansion differences and other thermophysical properties between the critical materials and thereby reduce stress and distortion.

The infrared heater can have a metal or ceramic mask placed between the lamp and the part to be heated. The mask, by absorbing or reflecting the infrared radiation, has the desired geometry to limit the radiation from heating the base material surface. Such a mask may protect temperature sensitive areas on the heated part such as coatings including paint, plating, and thermal sprayed coatings; joints including polymer adhesives or welded joints; adjoining temperature sensitive materials; and other heat treated areas. The mask can also be used to prevent distortion such as in threaded regions or in thin cross-sectional areas.

When a second infrared heater is used, it may be controlled independently of the first infrared heater that fuses the thermal spray coating to the base material. The second infrared heater is operated in a particular time-temperature cycle that produces the desired characteristics in the base material with only limited influence from the effects of the first infrared heater.

The method and apparatus of the invention, using infrared heaters, is thus capable of fusing a thermal spray coating on a base material to improve both the qualities of the thermal spray coating and the adhesion of the coating to the base material. The base material is optionally heat treatable independently of the fusing of the thermal spray coating, even though at least a portion of the heat treating cycle can be carried out simultaneously with the fusing cycle.

Other advantages, benefits, and features of the present invention will become apparent to those skilled in the art upon reading the detailed description of the invention.

DETAILED DESCRIPTION OF THE PREFERRED EMBODIMENT

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

Figure 1A:
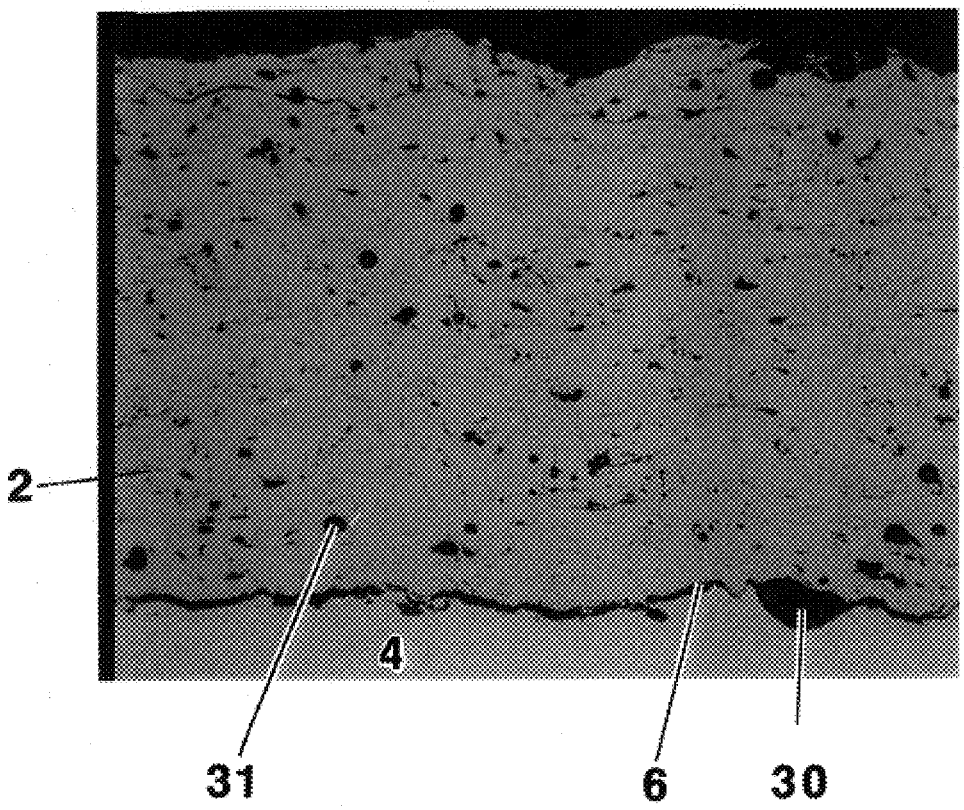
FIG. 1A Prior Art
FIG. 1A is a photomicrograph of the interface between a thermal spray coating and a base material of a typical prior thermal spray coated composite part.
Figure 1B:
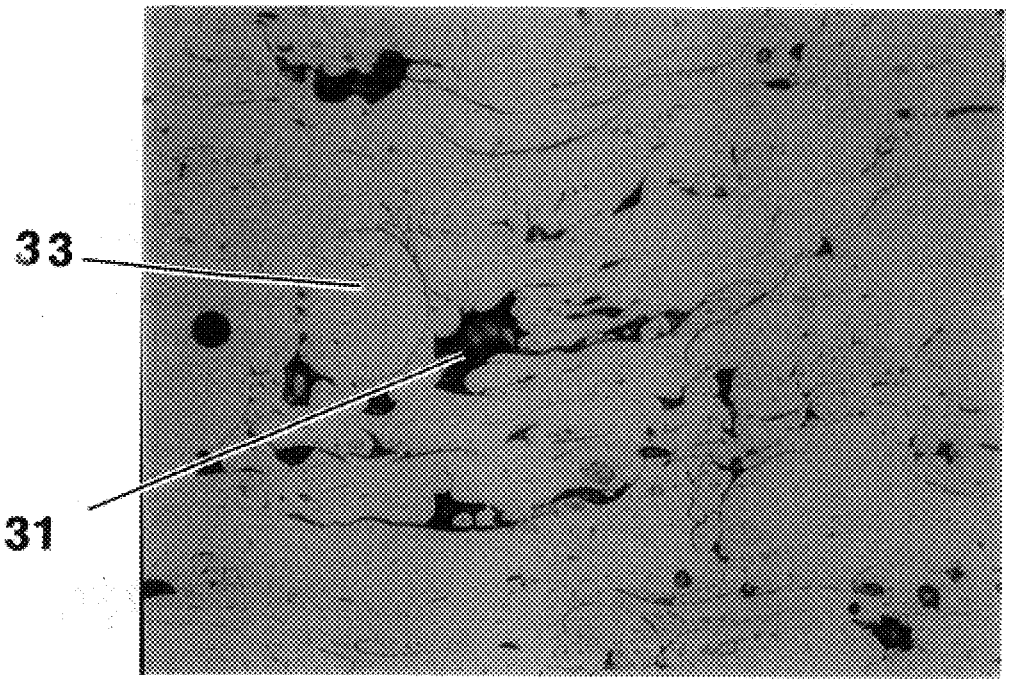
FIG. 1B Prior Art
FIG. 1B is a photomicrograph of a typical prior as-sprayed thermal spray coating.
Figure 1C:
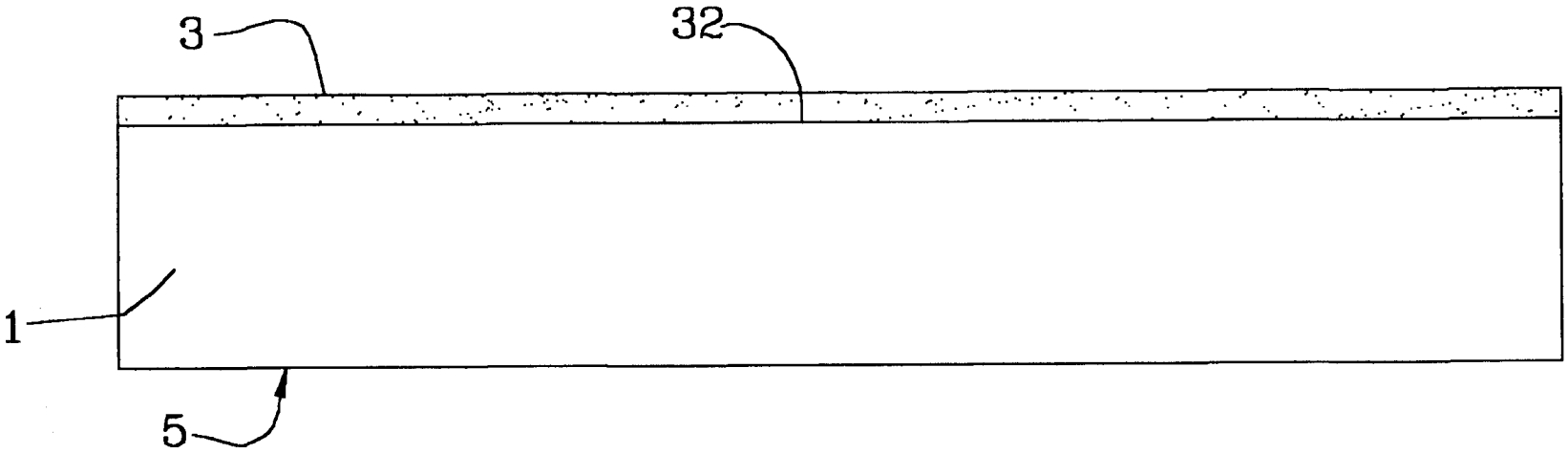
FIG. 1C is a schematic front view of a typical piece of base material to which a thermal spray coating has been applied to create a composite part.

Referring to FIG. 1C, a typical piece of base material 1 is illustrated having a surface 32 to which a thermal spray coating 3 has been applied. The surface 32 is generally chemically and/or mechanically roughened prior to coating. Mechanical roughening may be achieved by grit blasting to create a distinct roughened or dull surface finish. The thermal spray coating 3 may be any of a wide variety of metallic and non-metallic materials. The raw materials are in the form of powders that are often referred to as self-fluxing due to their low melting points. The invention also includes the use of thermal spray raw materials in wire form for use with electric arc and combustion processes. Materials for spray coating include nickel, chromium, boron, and silicon. Various additives such as tungsten carbide and chromium carbide can be added to the basic spray materials. Such thermal spray coating materials themselves are well known in the thermal spray art and form no part of the present invention. Similarly, the equipment for spraying the coating 3 onto the base material 1, as well as the particular process or processes that prepare the base material and accomplish the thermal spray coating, are well known and form no part of the present invention. Reference numeral 5 indicates the composite part consisting of the base material and the thermal spray coating.

During spraying, the powder approaches or exceeds its liquidus temperature, softens, and deforms on impact. A high degree of interparticle voids remain, as is apparent from photomicrographs routinely taken of as-sprayed coatings. The porosity is generally caused by interparticle spacing during the coating process. In FIG. 1C, the thermal spray coating is depicted as numerous small lamellae having randomly sized and oriented spaces between them. For clarity, the spaces between the lamellae are shown greatly exaggerated in size.

In accordance with the present invention, the relatively porous thermal spray coating 3 as applied by conventional methods and apparatus is fused into a homogeneous dense layer having improved microstructural features. For that purpose and in the illustrated description, the composite part 5 is placed in an infrared furnace 7, FIG. 2. The infrared furnace 7 includes an infrared heater 8. The infrared heater 8 is composed of at least one but preferably a bank of infrared lamps 9 that are arranged to lie in a plane parallel to the plane of the thermal spray coating 3 of the composite part. The number, wattage, and spacing of the infrared lamps 9 can vary to suit the application including part geometry, infrared characteristics, heating rate, maximum fusing temperatures required, etc. The bank of lamps does not have to lie in a single plane in order to heat a flat plate. A circumferential furnace design such as is shown in FIG. 2D may be used to heat a flat plate, a round bar, or a complex shape. Conversely, a planar bank can be used to heat non-planer parts. It will be appreciated that when processing thermal sprayed coated parts with complex shapes and non-planar surfaces, the plane of the bank of infrared lamps cannot be perpendicular to all the coated surfaces. The object of the invention is to always heat the material surface with radiation directed normal from the infrared lamp towards the desired surface and to maximize infrared furnace efficiency. That is, the infrared energy is always directed at the appropriate surface. For that purpose, the furnace may have a built-in reflector, i.e., a reflective coating. The internal reflector, as well as optional external reflectors, greatly assist with directing maximum infrared energy in the proper directions. FIG. 2A depicts a typical external parabolic mirror surface 16 that is useful in directing the radiation from an infrared lamp 9 over the full width of a flat composite part 5. The mirror 16 may be in the form of a reflective coating, such as gold or aluminum, deposited on a stainless steel material. FIG. 2B depicts a typical elliptical mirror 18 that directs radiation from a lamp 9' to a composite part 20 having a cylindrical thermal spray coated surface 22. Alternately, the lamp may have an internal reflector in the form of a reflective coating directly applied to part of the bulb surface to produce a pattern similar to FIG. 2A. In some instances, a flat, spherical, or other reflective surface can be used as the mirror. In FIG. 2C, a flat composite part 24 is moved in the directions of arrows 26 to enable concentrated heating on the part coated surface 28. Of course, the part 24 may be held stationary if desired, and the lamp 9' and mirror 18' moved in the directions of the arrows 26.

Infrared lamps that are satisfactory for practicing the invention range from approximately 100 watts to over 6,000 watts, with the usual range being between approximately 1,000 watts and 6,000 watts. They typically are constructed as quartz tubes with tungsten elements and filled with a halogen atmosphere. Such lamps are commonly designated T3 bulbs. Quartz transmits infrared energy effectively and may be located between parts and lamps without significant effect on the heating characteristics. The lamp lengths can range from approximately one inch to 100 inches, with a range of six inches to 24 inches being most common. A diameter of approximately 0.38 inches to 0.50 inches is common. For this work, the infrared short wave lamps emit generally 0.78 to 1.5 micrometers wavelength of the infrared spectrum. The distance D, FIG. 2, from the composite part to the infrared lamp is variable to suit the particular application. A distance D of from zero to five inches is common.

Figure 3:
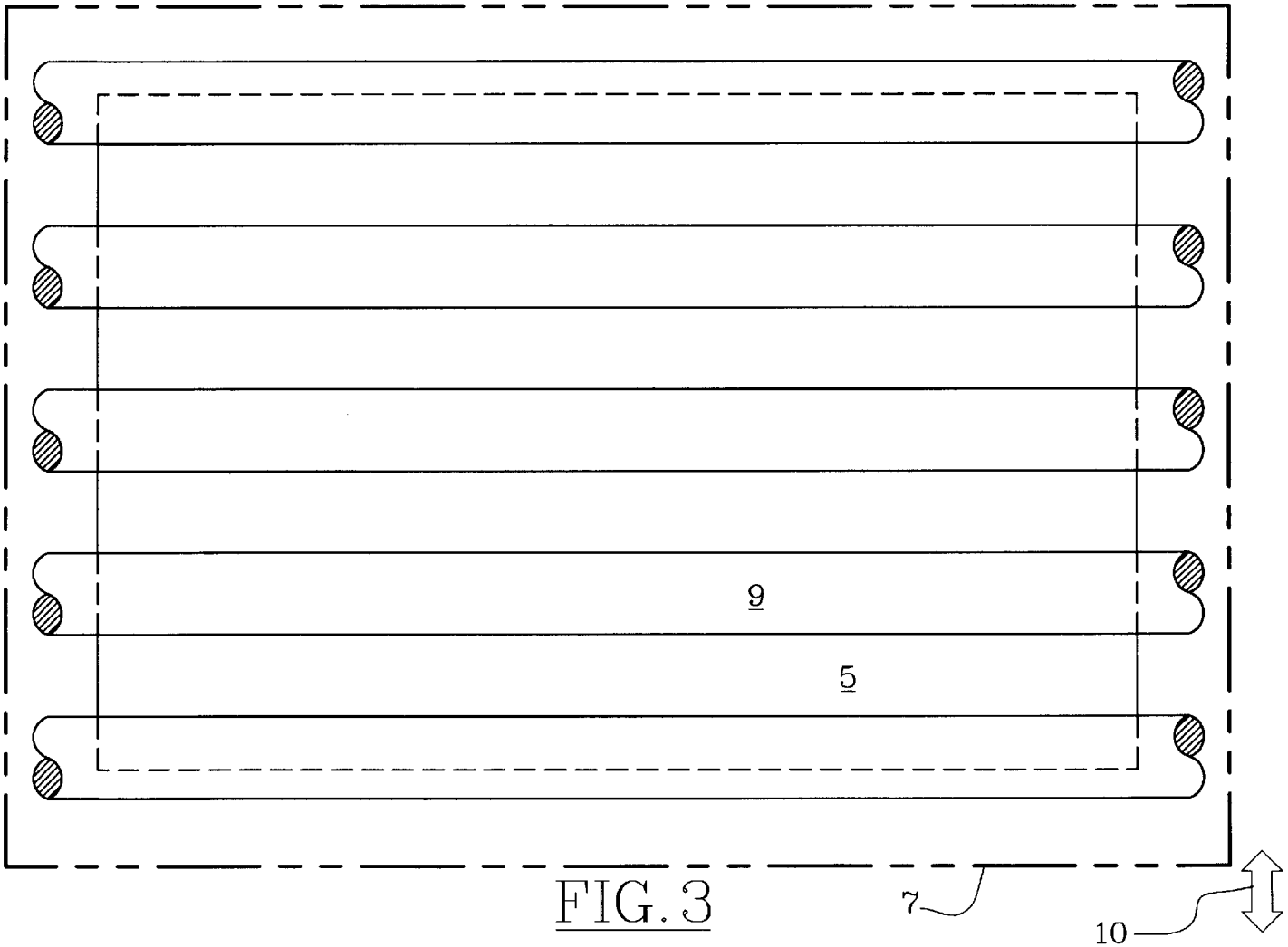
FIG. 3 is a view taken along line 3—3 of FIG. 2.

The composite part 5 can be held stationary relative to the infrared lamp 9. Alternately, the furnace 7 can be designed to reciprocate the composite part relative to the lamp in the direction of arrows 10 parallel to the plane of the thermal spray coating 3. See FIG. 3. The atmosphere within the furnace may be vacuum, inert gas(es), reactive gas(es), or ambient air, again depending on the specific requirements of the composite part.

Figure 6:
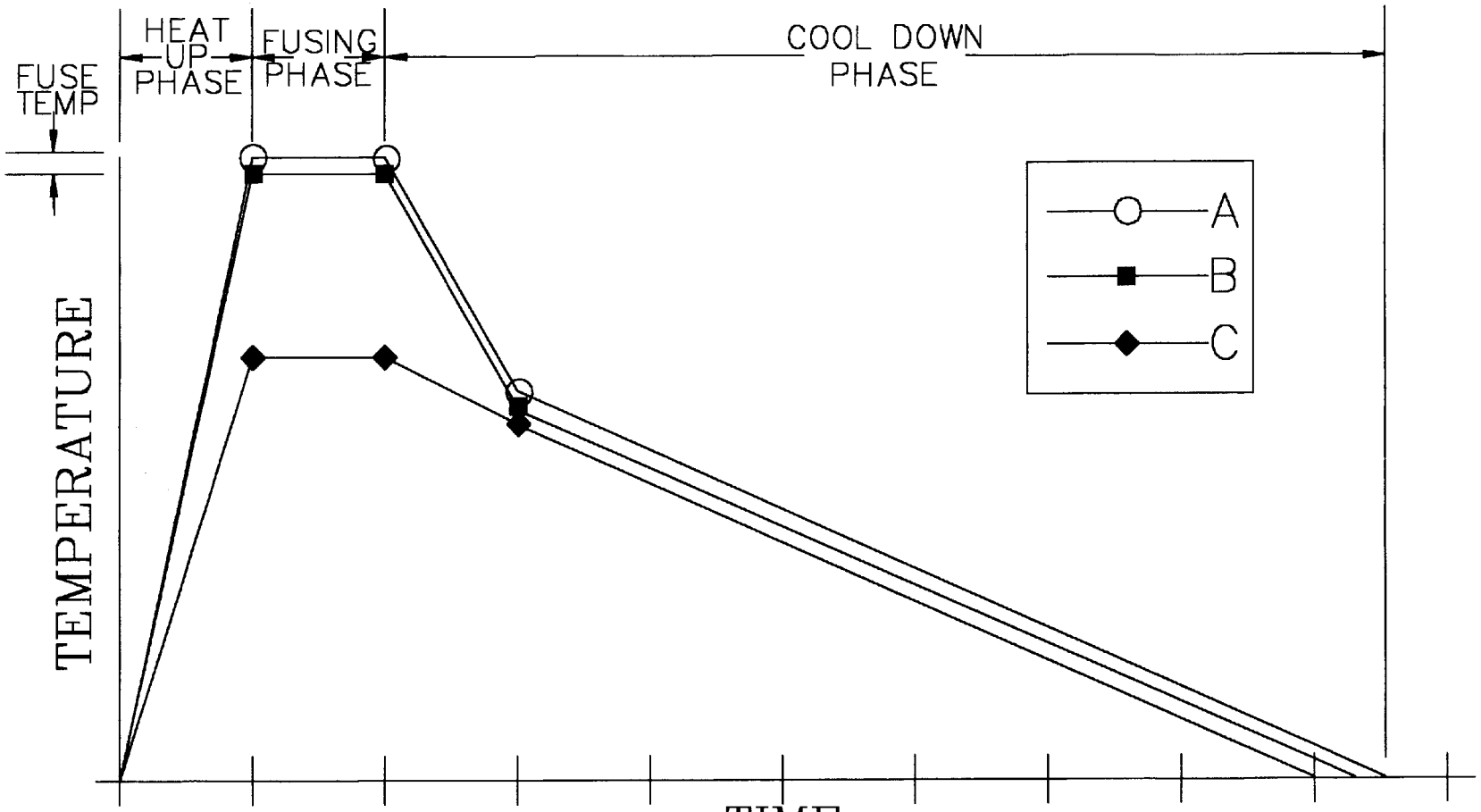
FIG. 6 is a typical time-temperature curve for a thermal spray coating fusing phase.

At the start of a fusing phase, the infrared lamps 9 are energized to unidirectionally heat the thermal spray coating 3 and the underlying portion of the base material 1 of the composite part 5. A typical fusing phase is shown in FIG. 6. That Figure shows the temperature at different regions within the composite part. Line A identifies the temperature at the coating surface. Line B identifies the temperature maintained at the coating/base material interface using an embedded or non-contact thermocouple. Line C shows the temperature at the base if material outer surface. In some situations, the temperatures are uniform throughout the composite part. For a simple part geometry, the term uniform means either the same approximate temperature throughout, or the same approximate temperature within a given plane parallel to the infrared lamps.

The heat-up phase of FIG. 6 represents the time after the bank of infrared lamps 9 has been energized until the thermal spray coating 3 reaches its fusing temperature. The time required for the heat-up phase is dependent upon the furnace characteristics and the application requirements. Various thermophysical properties of the coating and of the base material 1, including thermal expansion coefficients and thermal conductivity values are important considerations. The infrared absorption and emissivity values of the coating and base material are another important factor. A slight thermal gradient is produced through the thermal spray coating thickness due to the unidirectional heating method.

During the coating fusing phase, the temperature at the surface of the thermal spray coating 3 (Line A) is held slightly above the liquidus temperature for the particular coating material. In rare cases, it may be possible to fuse the coatings slightly below the liquidus temperature. Typically, depending on the coating composition, the temperature at the surface of the thermal spray coating is approximately 1800 to 2250 degrees Fahrenheit. The coating wets the base material surface, and it may form a coating/base material mixture at the interface. The temperatures at the coating/base material interface (Line B) and at the base material surface (Line C) are dependent upon the thermal conductivity of the coating and of the base material, and the infrared absorption and emissivity characteristics of the coating, base material, and interfacial components. The time held at the fusing temperature is very short and is dependent upon the thermophysical properties of the coating, including grain growth properties desired or to be prevented.

Figure 4:
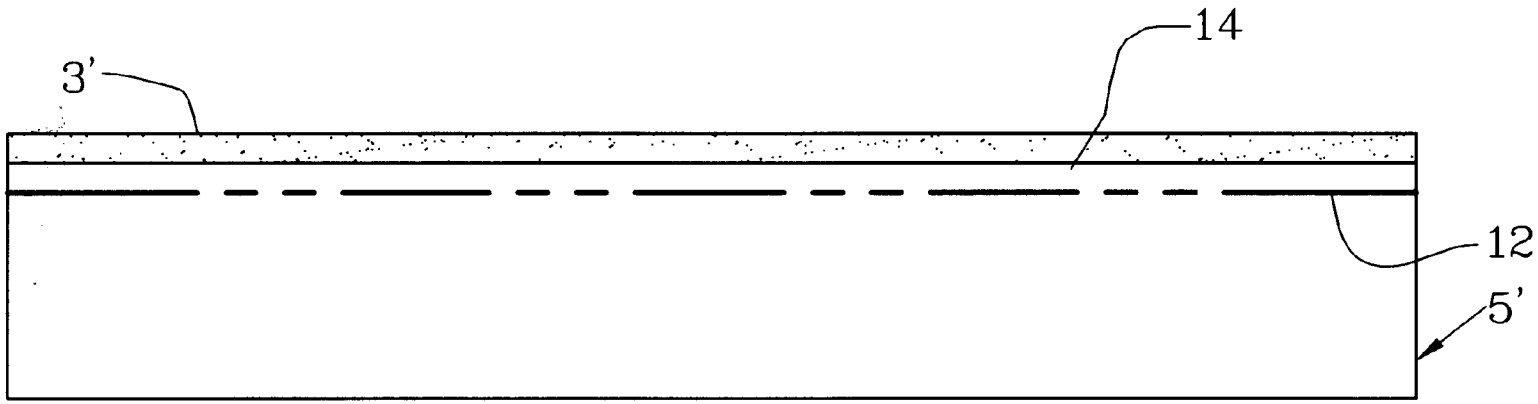
FIG. 4 is a view similar to FIG. 1C, but showing the thermal spray coating of the composite part fused into a coating having greatly improved microstructural features compared with an as-sprayed coating.

At the end of the fusing phase, the original individual platelets of the thermal spray coating 3 have fused together into a coating 3', FIG. 4, that is denser and more homogeneous and that has higher adhesive and cohesive strengths than the original coating. The infrared heater 8 is then de-energized. The thermal spray coating 3' cools during a cool-down phase.

At the end of the cycle, the coating properties, such as density, hardness, surface finish, wear and impact resistance, and adhesive and cohesive strengths have been enhanced. Diffusion between adjacent or nearby platelets and between platelets and the base material have occurred. This creates a more homogeneous chemistry in the coating microstructure and usually a gradual or graded chemistry between the coating and the base material chemistry. This widens the base material—coating interface, reducing concentrated stress levels from the as-sprayed composite part.

Figure 9:
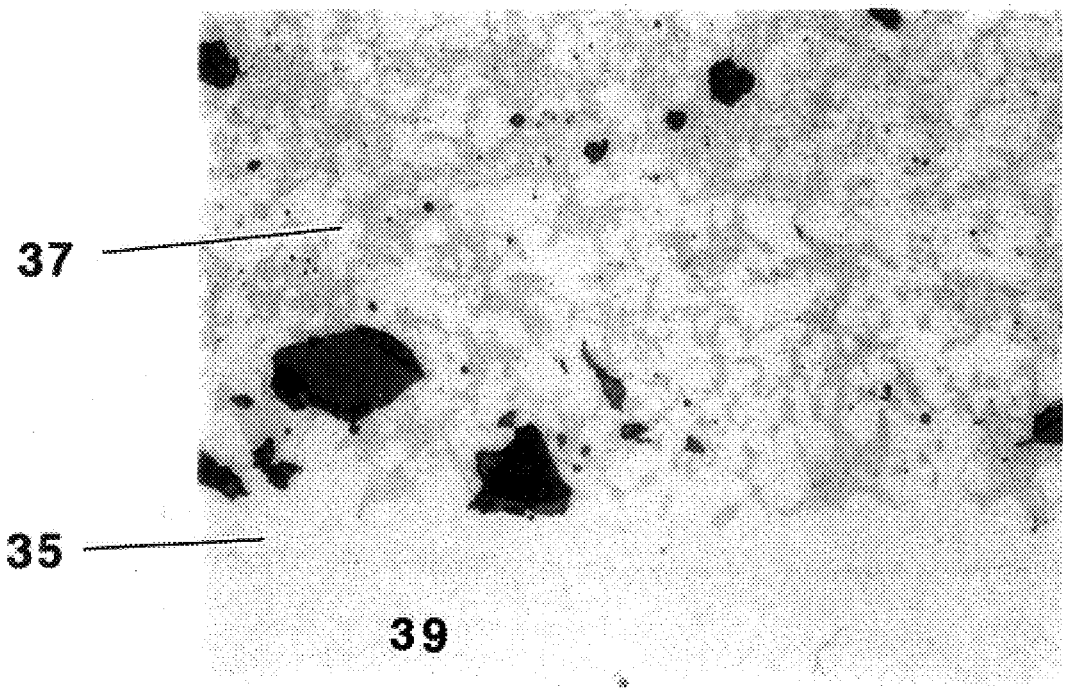
FIG. 9 is a photomicrograph generally similar to FIG. 1A, but showing the interface between a thermal spray coating and a base material after the thermal spray coating has been fused in accordance with the present invention.

FIG. 9 shows a photomicrograph at 500× magnification of the interface 35 between a fused thermal spray coating 37 and a base material 39 as achieved using the apparatus and process of the present invention. No globular particles are visible. There is no delamination/debonding present at the interface 35. On the contrary, the thermal spray coating constituents 37 have diffused into the base material 39, and the base material constituents have diffused into the coating. The large irregularly shaped black areas are entrapped grit blast media. Some porosity does exist and is the smaller more spherical shaped areas.

Figure 2:
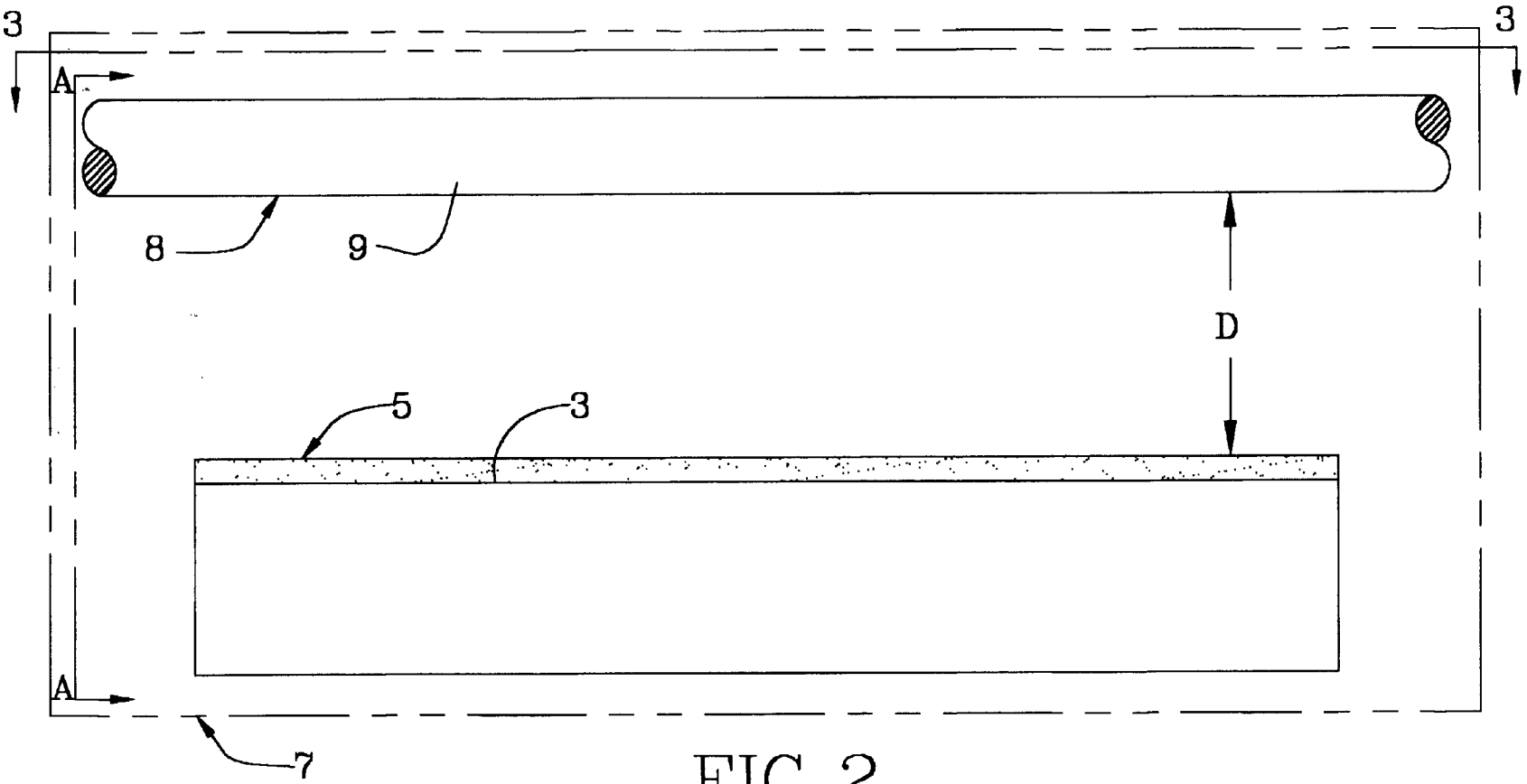
FIG. 2 is a schematic view of the composite part of FIG. 1C placed in an infrared furnace.
Figure 2A:
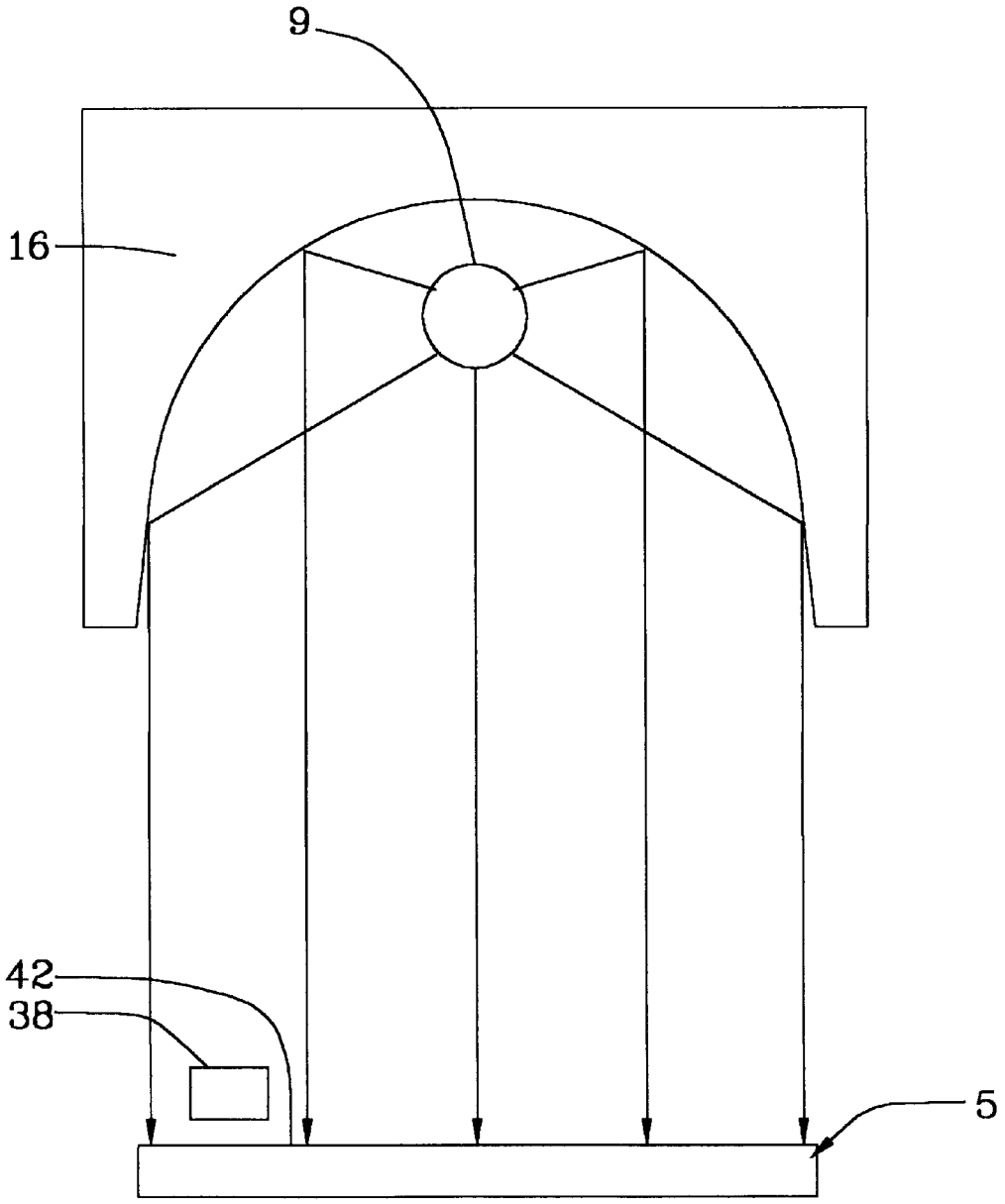
FIG. 2A is a view on a reduced scale taken along line A—A of FIG. 2 showing in schematic form a typical parabolic mirror used in conjunction with the present invention.
Figure 2B:
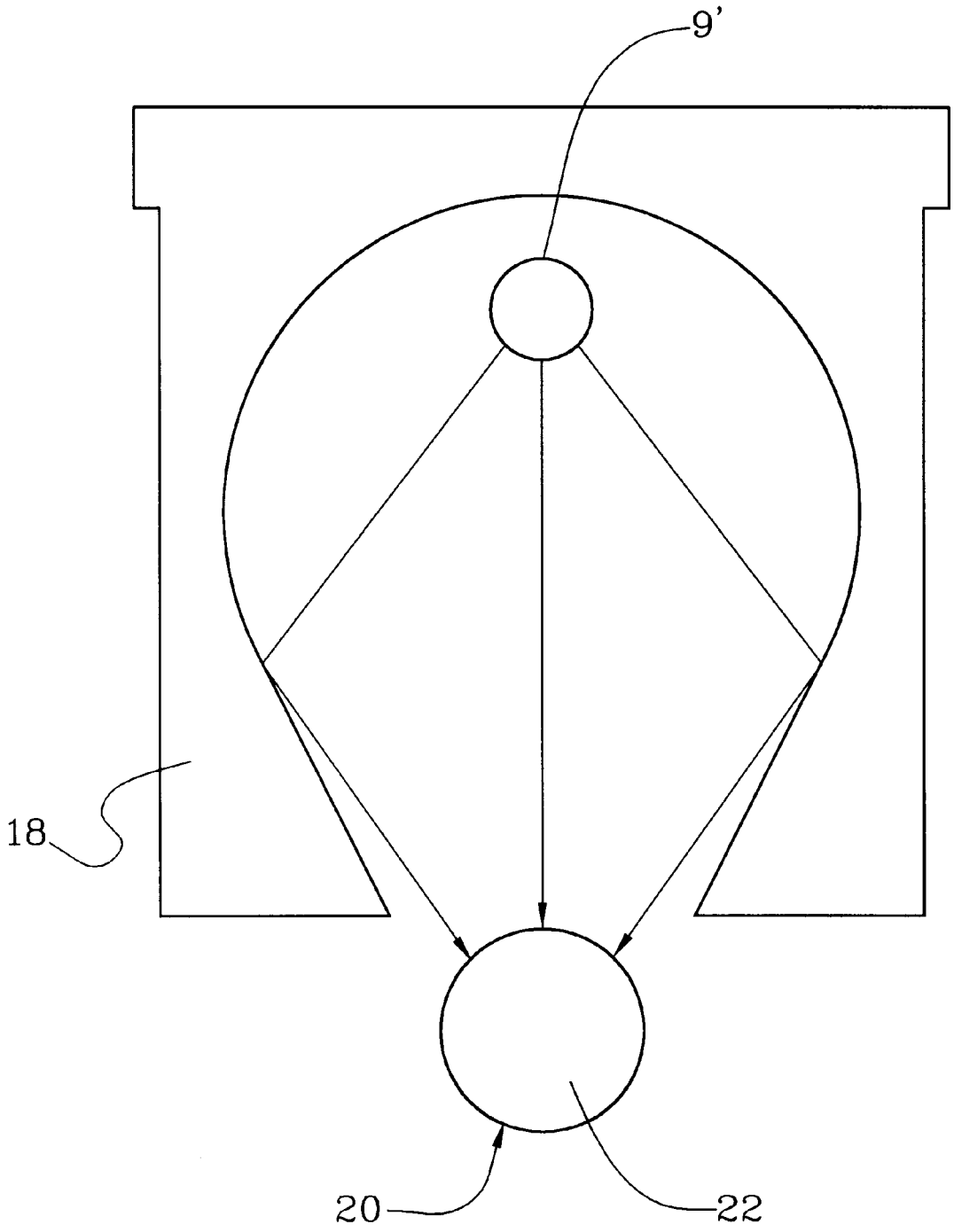
FIG. 2B is a view similar to FIG. 2A, but showing a typical elliptical mirror used with a composite part having a non-planar thermal spray coated surface.
Figure 2C:
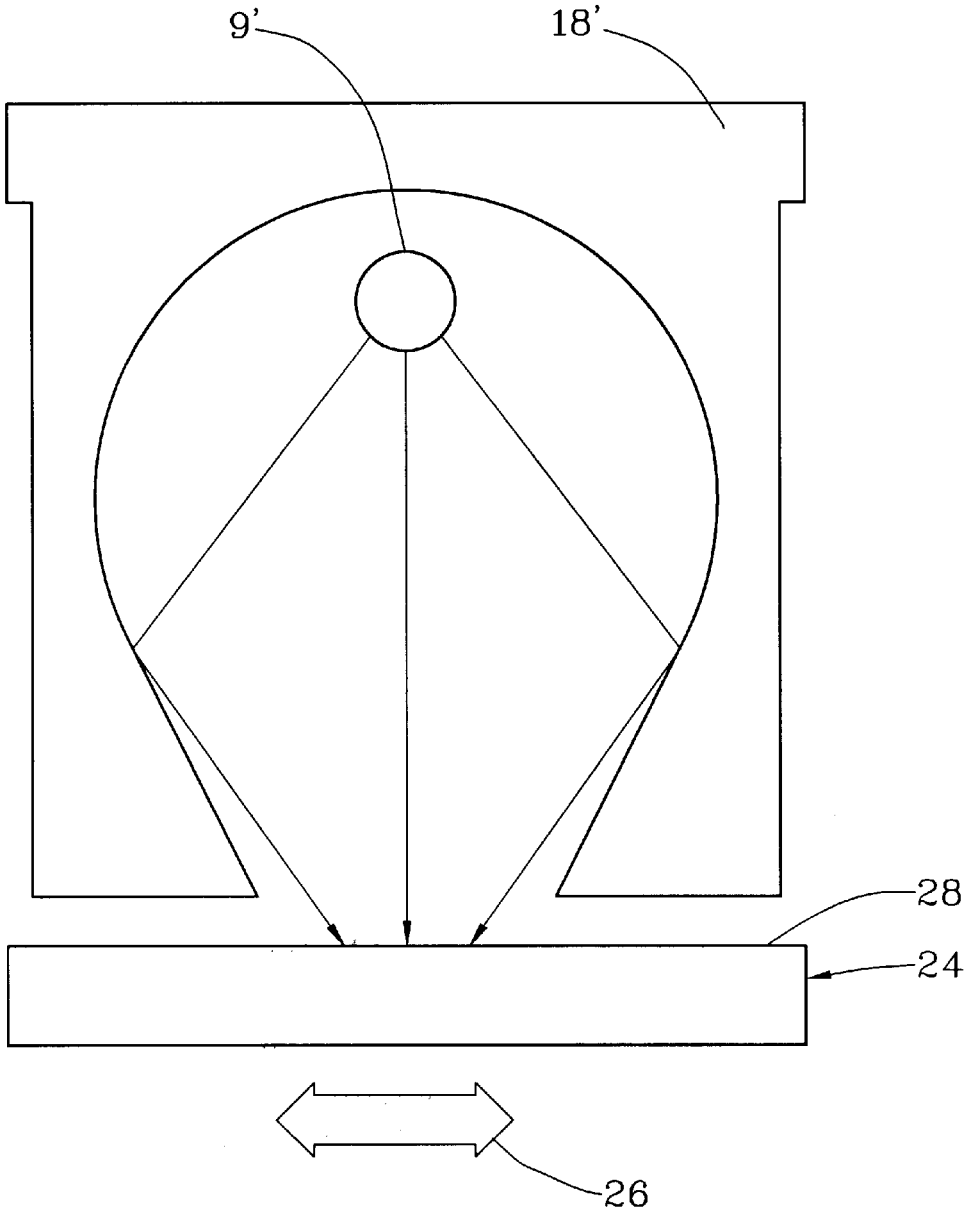
FIG. 2C is a view similar to FIG. 2B, but showing a typical elliptical mirror used with a composite part having a planar thermal spray coated surface.
Figure 2D:
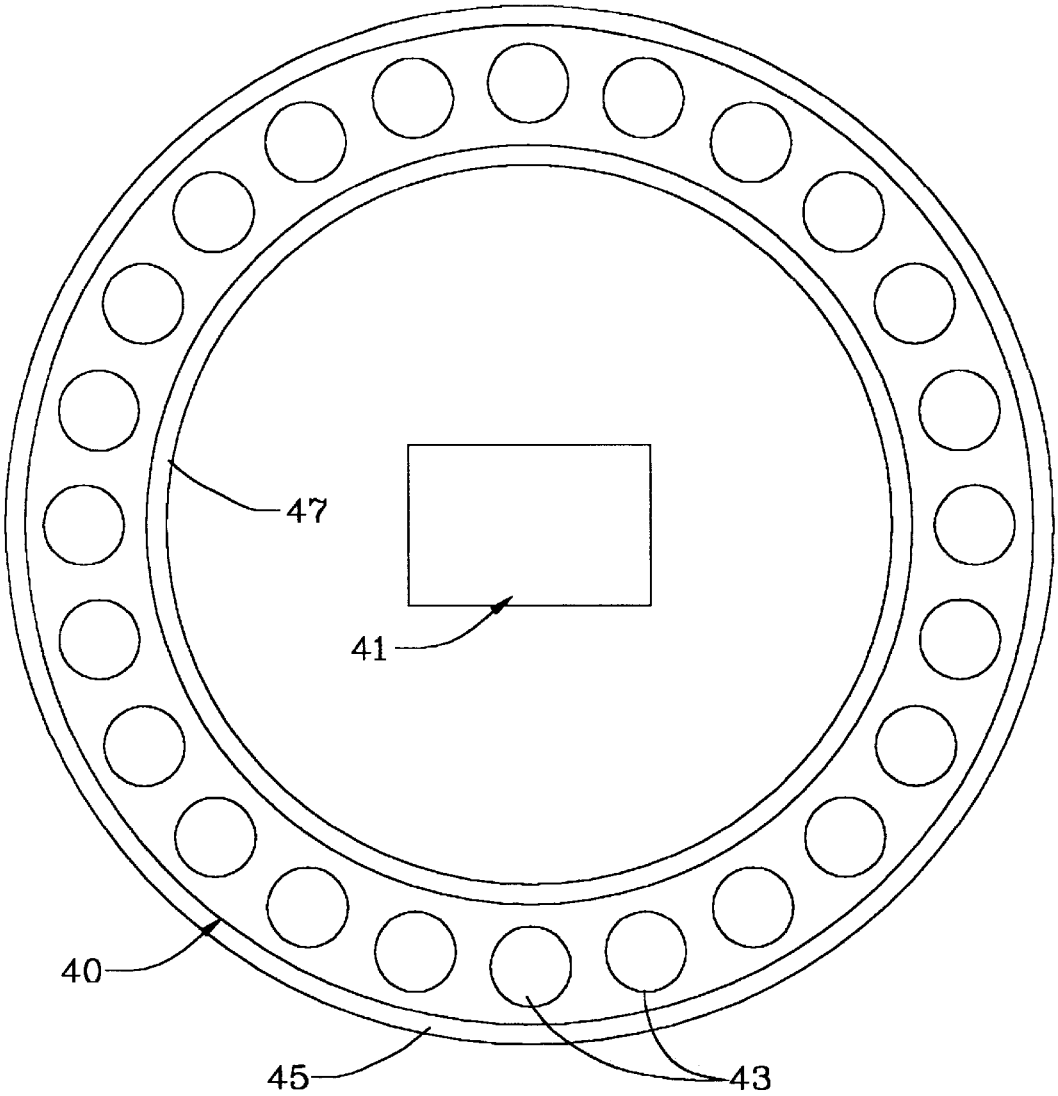
FIG. 2D is a simplified cross sectional view of a typical infrared heater, which has infrared lamps arranged circumferentially around a composite part.

Because the process of the invention heats only the composite part, a significant thermal gradient exists between the cooler atmosphere and walls of the infrared furnace 7, and the infrared heated surfaces of the composite part 5, FIG. 2. That is because the infrared lamps 9 heat only the surfaces at which the radiation is directed and absorbed. The thermal gradient produces a quenching effect on all the surfaces that have absorbed the infrared radiation, which is referred to as the cold wall process.

Figure 7:
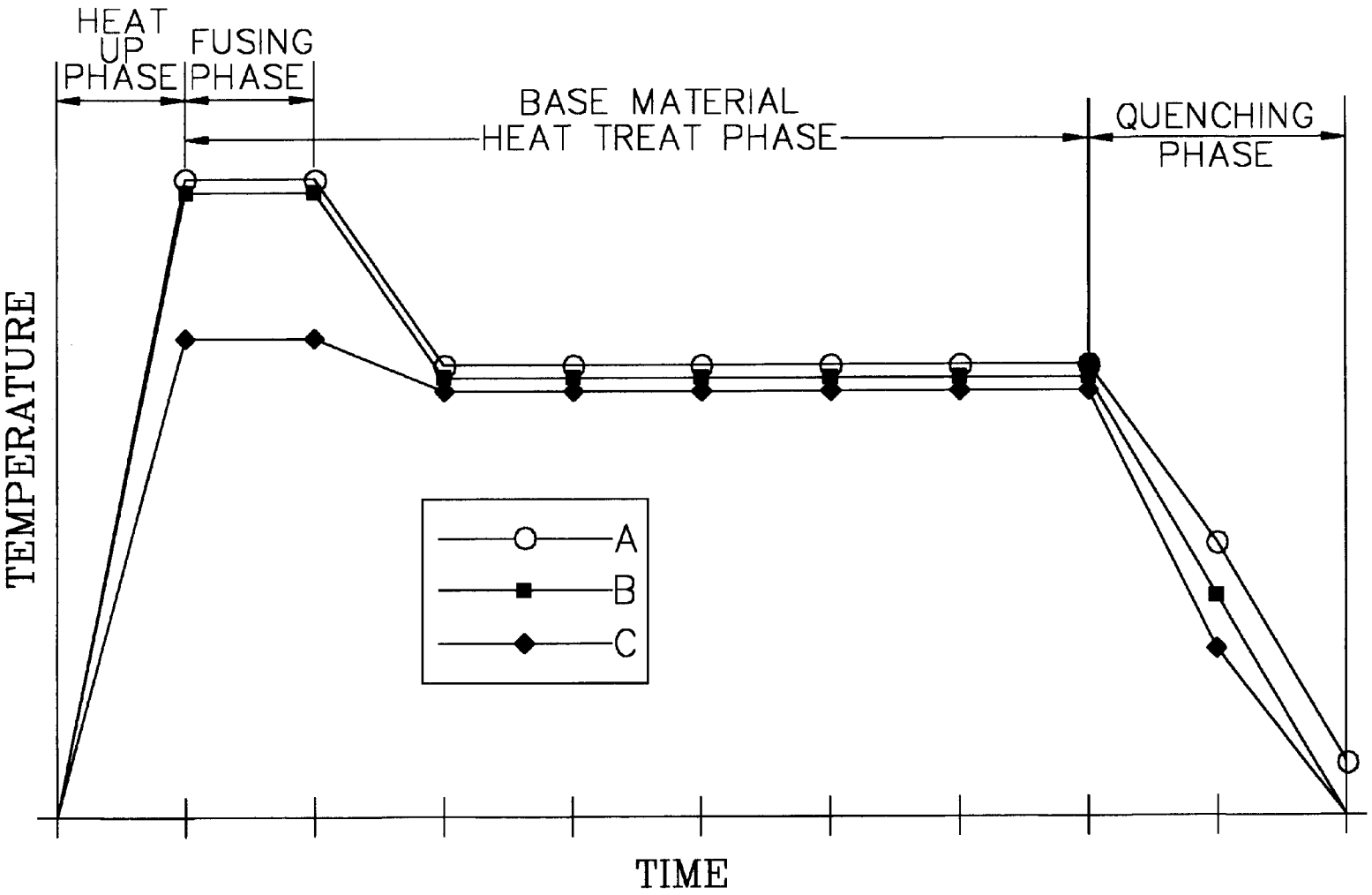
FIG. 7 is a typical time-temperature curve for a fusing phase and for a heat treating phase of the base material.

As described thus far, the fusing process of a thermal spray coating is applicable with a wide variety of base materials, both ferrous and non-ferrous, whether or not the base materials are heat treatable. Further in accordance with the present invention, a heat treatable base material of the composite part 5 can be heat treated in situ with the fusing phase for the thermal spray coating 3. For example, the base material may be a ferrous heat treatable material such as carbon steel, alloy steel, tool steel, or martensitic stainless steel. To achieve a hardened steel part, the part must be heated to form austenite and rapidly cooled. Turning to FIG. 7, the base material heat treating phase begins at the beginning of the fusing phase. The base material heat treating phase reveals the temperature required for a ferrous heat treatable material to adequately transform into the austenitic phase. The specific temperature and time required varies for each base material composition and mass, but the desired austenitizing temperature will generally be lower than the coating fusing temperature.

Upon completion of the base material heat treating phase, the base material 1, along with the thermal spray coating 3, undergoes a quenching phase. The quenching phase represents the rate of temperature decline to cool a ferrous base material from the austenitizing temperature to approximately ambient temperature. The cooling rate is determined by the desired base material microstructure (e.g., bainite, martensite, pearlite, ferrite, etc.) and physical properties including hardness, tensile strength, yield strength, etc. desired. The cooling method varies with the specific application, but it may include cooling the thermal spray coating and/or the base material surfaces with water, oil, dry ice, carbon dioxide pellets, liquid nitrogen, and stagnant or compressed air or other gas mixtures, etc. Fast quench rates may also be required to attain the proper base material microstructure and can be achieved by cooling the base material surface using a water cooled copper plate. Although the cold wall process is present throughout the heat-up, fusing, heat treating, and quenching phases, it is advantageous primarily during the quenching phase.

Figure 5:
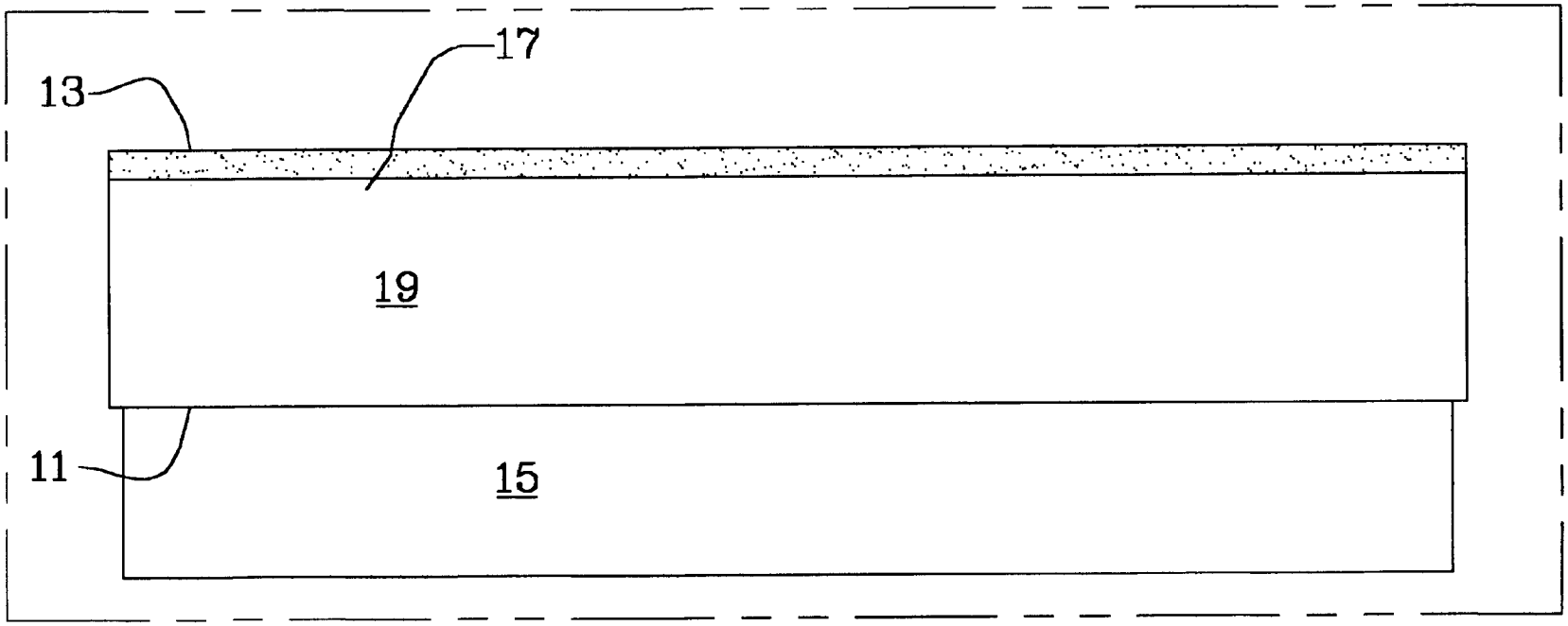
FIG. 5 is a partial view similar to FIG. 2, but showing the base material of the composite part in contact with a heat sink.

Turning to FIG. 5, fast quench rates are obtainable by providing additional cooling to the base material surface 11 opposite the thermal spray coating 13. A heat sink, such as a water cooled fixture 15, is placed in direct contact with the base material surface 11. Other heat sinks are also acceptable. Passing inert gas (helium, argon), or a low boiling point non-flammable liquid such as liquid nitrogen, or a solid that sublimes upon heating, i.e., dry ice, over the thermal spray coating 17 on the base material 19 will accomplish even faster quenching rates when the water cooled fixture is used. By applying the proper heat treat time-temperature and quenching parameters to the composite part, the surface of the base material under the thermal spray coating 3' can be hardened to a desired hardness and to a desired depth, as represented by line 12 in FIG. 4.

If desired, additional heat treating cycles may be performed on a steel base material. For example, after fusing, heat treating, and quenching, the base material can be reheated below the austenitizing temperature for a selected time to temper or stress relieve the base material. The result is then a composite part having a more ductile base material 1 compared to a hardened and quenched base material, but with a fused thermal spray coating 3' and a hardened and tempered layer 14. The operation may also be performed by using a bank of infrared lamps on the side of the composite part opposite the thermal spray coating.

Figure 8:
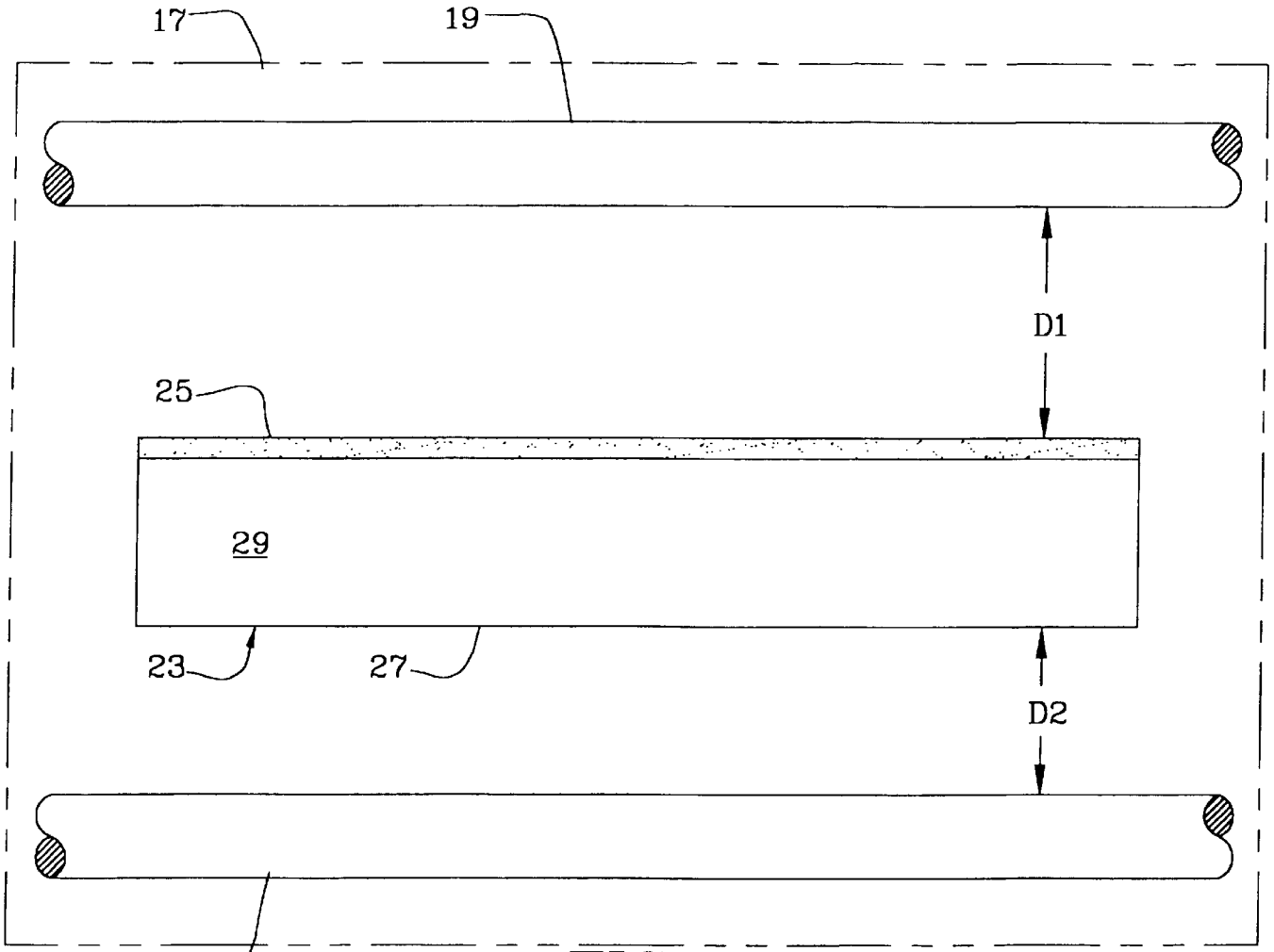
FIG. 8 is a view generally similar to FIG. 2, but showing an infrared furnace having two infrared heaters.

The present invention is also concerned with heat treating the base material by a bidirectional application of heat. In FIG. 8, an infrared furnace 17 has a first infrared heater 19 and a second infrared heater 21. A composite part 23 is placed in the furnace 17. The thermal spray coating 25 is at the desired distance D1 from the first infrared heater 19. The surface 27 of the base material 29 opposite the thermal spray coating 25 is located at a distance D2, which may but need not be equal to the distance D1, from the second infrared heater 21. The two infrared heaters may be controlled independently of each other to produce different time-temperature characteristics on the opposite sides of the base material 29 and thus produce different properties within the base material. It will be appreciated that the second infrared heater can also be used to heat the base material faster and uniformly and thus produce the desired properties throughout the base material in a manner that is similar to a single infrared heater. For example, a second infrared heater promotes microstructural uniformity and less grain growth with a shorter cycle time.

The infrared process, which is a line-of-sight process, applies the infrared energy to all portions of a coated surface that are exposed to the infrared heater. In some composite parts, it may be desirable to protect certain portions from the infrared energy. For example, the composite part may have thin sections, plastic components, or weld joints that would be harmed if exposed to the infrared energy. In those cases, a mask is interposed between the affected portion and the infrared heater. The preferred mask material is one that absorbs the infrared energy. The mask must have sufficient mass to withstand the temperature to which it will be heated. In many cases a mask made of carbon steel is satisfactory. In FIG. 2A, reference numeral 38 represents a mask that shields the portion 42 of the composite part 5 from the rays of the lamp 9.

The infrared process has many advantages over induction hardening, a widely used process for numerous commercial heat treating applications. For example, unlike infrared heating, induction hardening generally requires a device to encircle a portion or the whole part, i.e., induction coil, to adequately heat it. Induction heating works well with treating simple shapes, while infrared heating can heat both simple and complex shapes. Secondly, the distance between the infrared lamp and a plate surface can vary between zero and approximately five inches without significant differences in the heating rates of the composite plate, whereas the distance between an induction coil and plate surface is critical. In addition, with larger plates, infrared lamps can heat the entire surface uniformly, which minimizes thermal stress. Induction coils, on the other hand, heat the part by scanning progressively, which creates uneven expansion and contraction and thus creates undesirable thermal stress.

As an example of a product produced using the present invention, a base material of stainless steel AISI Type 304 material having a length of three inches, a width of 1.50 inches, and a thickness of 0.24 inches was coated with a NiCrBSi thermal spray coating. The thermal spray coating was 0.020 inches thick. The composite part was placed in an infrared furnace 40 having an infrared heater of a bank of 22 lamps 43 arranged circumferentially in the manner of FIG. 2D. In FIG. 2D, the composite part is indicated at reference numeral 41. The infrared lamps were 1500 watts. The lamps were arranged in a circumference slightly larger than a four-inch diameter so as to make a cylindrical heating region four inches in diameter and eight inches long. The composite part was located in the center of the cylindrical heating region. A gold coating 45 capable of sustaining high temperatures surrounding the lamps 43 reflected at least 95 percent of the infrared radiation from the lamps to the composite part 41. A quartz tube 47 was inside the lamps; infrared radiation was effectively transmitted through the quartz. Heating was performed in a vacuum.

Figure 10:
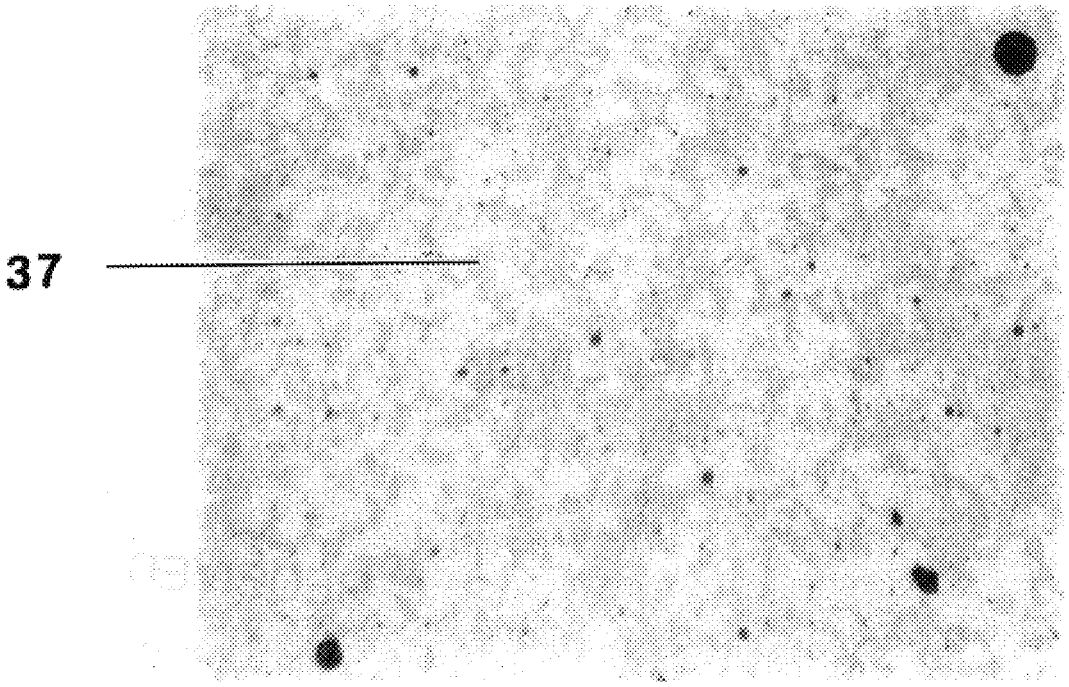
FIG. 10 is a photomicrograph generally similar to FIG. 1B, but showing the thermal spray coating after it has been fused in accordance with the present invention.

The bank of infrared lamps 43 was manually controlled to ramp from ambient to a soak temperature of 1949–1958 degrees Fahrenheit in one minute twenty-two seconds. The average power consumption was approximately 30 kilowatts during the heat-up phase. The fusing time at temperature was two minutes two seconds, which maintained a temperature of approximately 1949–1958 degrees Fahrenheit on the coating surface. Subsequently, the composite part was cooled in helium for 17 minutes with low flow rate and then removed from the furnace. Upon cooling, the thickness of the thermal spray coating was 0.015 inches to 0.016 inches. The coating did not shrink in either direction from the edges of the coated surface. Calculations indicate that the density of the coating was therefore increased by approximately 25 percent through the fusion process excluding surface finish changes in the coating. Likewise, an improvement in the microhardness of the coating resulted from the fusion process. Average coating microhardness in the as-sprayed condition was 595 HV. After fusion, the coating microhardness increased to 776 HV. This increase in hardness was accompanied by a decrease in the standard deviation of from 96 in the as-sprayed condition to 42 in the fused condition. This generally is an indication that the coating density was increased. The result was a composite part having a fused coating with properties considerably enhanced over those of the original thermal sprayed unfused and unheat treated composite part. Referring again to FIGS. 9 and 10, the diffusion at the interface 35 between the coating 37 and the base material 39 is clearly seen. In fact, even at high magnification the original interface is not visible. Similarly, the diffusion between the coating platelets is apparent.

In summary, the results and advantages of thermal spray coatings can now be more fully realized. The composite part of the thermal spray coating and the base material provides multiple selected properties that can be varied to suit a wide variety of applications. This desirable result comes from using the combined functions of the infrared furnace. The infrared heater applies unidirectional heating to the thermal spray coating in a manner that fuses the coating into a dense and substantially homogenous layer having improved microstructural features such as surface finish, hardness, interfacial uniformity, density, intersplat uniformity, cohesive strength, and adhesive strength. The base material underlying the thermal spray coating can be heat treated simultaneously with the fusing of the thermal spray coating, thus performing two independent processes on the composite part without having to remove it from the infrared furnace. The cold wall process can be used to provide additional control to the quenching phase of the cycle. Infrared heaters can be located on both sides of a composite part to increase the versatility and production rate of heat treating the base material as well as to fuse thermal spray coatings on both sides of the part.

The infrared furnace offers a wide variability of heat treating parameters that can be tightly controlled, such as heating rate, thermal gradients, soak times, and quench rates. The thermal gradients, which can be tailored for a specific application, are larger than most other known processes.

It will also be recognized that in addition to the superior performance of the invention, its cost is modest when compared with the benefits it provides. Consequently, even relatively small manufacturing facilities can enjoy the advantages available from the fusing and heat treating processes.

Thus, it is apparent that there has been provided, in accordance with the invention, methods for fusing thermal spray coatings and heat treating base materials using infrared heating that fully satisfy the aims and advantages set forth above. While the invention has been described in conjunction with specific embodiments thereof, it is evident that many alternatives, modifications, and variations will be apparent to those skilled in the art in light of the foregoing description. For example, transfer tapes, gels, etc. are known that can apply metallic and non-metallic coatings to a base material using non-thermal spray processes. Such coatings are brushed, painted, or adhesively bonded to the base material. The coating particles can be fused to each other and metallurgically bonded to the base material using infrared energy in the same manner and with the same results as with thermal spray coatings. Accordingly, it is intended to embrace all such alternatives, modifications, and variations as fall within the spirit and broad scope of the appended claims.

I claim:

1. A method of manufacturing a composite part comprising the steps of:

a. covering at least one surface of a heat treatable ferrous base material having initial properties of hardness, yield strength, and tensile strength at an ambient temperature and capable of forming austenite with a selected coating material having a liquidus temperature and containing at least one of the elements chromium, nickel, boron, and silicon and having initial properties of density, hardness, surface finish, wear and impact resistance, and adhesive and cohesive bond strengths at an ambient temperature;

b. applying a first amount of infrared energy from a source thereof to the coating sufficient to heat the coating to a first temperature of at least approximately 1800 degrees to 2250 degrees F. and thereby altering the initial coating properties of density, hardness, surface finish, wear and impact resistance, and adhesive and cohesive bond strengths relative to the respective initial properties, and simultaneously heating the base material with the first amount of infrared energy to a second temperature sufficient to form austenite in the base material;

c. applying a second amount of infrared energy less than the first amount to the coating and cooling the coating to a third temperature less than the liquidus temperature while maintaining the base material at substantially the second temperature; and d. quenching the composite part to the ambient temperature and thereby improving the base material properties of hardness, yield strength, and tensile strength relative to the respective initial properties and improving the coating properties of density, hardness, surface finish, wear and impact resistance, and adhesive and cohesive bond strengths relative to the respective initial properties at the ambient temperature.

2. The method of claim 1 wherein the step of covering a surface of a heat treatable ferrous base material comprises the step of thermal spraying a thermal spray coating of the selected coating material onto the base material.

3. The method of claim 1 wherein the step of covering a surface of a heat treatable ferrous base material comprises the step of applying a gel of the selected coating material onto the base material.

4. The method of claim 1 wherein the step of covering a surface of a heat treatable ferrous base material comprises the step of adhesively bonding a tape of the selected coating material onto the base material.

5. The method of claim 1 wherein the step of applying the first amount of infrared energy comprises the steps of:

a. continuously applying infrared energy in a heat-up phase for the coating of a first predetermined time and heating the coating from an ambient temperature to the first temperature; and b. continuously applying infrared energy in a fusing phase of a second predetermined time for the coating without interruption subsequent to the heat-up phase and maintaining the coating at substantially the first temperature during the fusing phase.

6. The method of claim 5 wherein:

a. the step of continuously applying infrared energy in a heat-up phase for the coating comprises the step of continuously applying infrared energy in a heat-up phase for the base material during the first predetermined time and heating the base material from the ambient temperature to the second temperature; and b. the step of continuously applying infrared energy in the fusing phase for the coating comprises the step of continuously applying infrared energy in a heat treating phase for the base material during the second predetermined time during which time austenite forms in the base material.

7. The method of claim 5 wherein the step of applying the second amount of infrared energy comprises the step of continuously applying the second amount of infrared energy without interruption subsequent to applying the first amount of infrared energy for a third predetermined time and maintaining the base material at substantially the second temperature during the third predetermined time, so that austenite continues to form in the base material during the third predetermined time.

8. The method of claim 1 comprising the further step of reheating the composite part with infrared energy after quenching the composite part to a selected temperature less than the second temperature for a selected time and thereby tempering or stress relieving the base material without affecting the coating.

9. The method of claim 1 comprising the further step of interposing a mask between the source of the infrared energy and a selected portion of the composite part prior to applying the first amount of infrared energy and thereby shielding the selected portion of the composite part from the infrared energy.

10. A method of manufacturing a composite part comprising the steps of:

a. providing a heat treatable ferrous base material having first and second surfaces and capable of forming austenite and having initial properties of hardness, yield strength, and tensile strength;

b. covering the first surface of the base material with a selected coating material having a liquidus temperature and containing at least one of the elements chromium, nickel, boron, and silicon and having initial properties of density, hardness, surface finish, wear and impact resistance, and adhesive and cohesive bond strengths;

c. applying a first amount of infrared energy from a first source thereof to the coating sufficient to heat the coating to a first temperature of at least approximately 1800 degrees F., and simultaneously heating the base material adjacent the first surface thereof with the first amount of infrared energy to a second temperature sufficient to form austenite in the base material adjacent the first surface thereof;

d. applying a second amount of infrared energy from the first source less than the first amount to the coating and cooling the coating to a third temperature less than the liquidus temperature and thereby altering the coating properties of density, hardness, surface finish, wear and impact resistance, and adhesive and cohesive bond strengths relative to the respective initial properties while maintaining the base material adjacent the first surface thereof at substantially the second temperature, and simultaneously applying a third amount of infrared energy from a second source thereof to the second surface of the base material and heating the base material adjacent the second surface thereof to a third temperature sufficient to form austenite in the base material adjacent the second surface thereof; and e. quenching the composite part and thereby improving the base material properties of hardness, yield strength, and tensile strength adjacent the first and second surfaces thereof relative to the respective initial properties and thereby improving the coating properties of density, hardness, surface finish, wear and impact resistance, and adhesive and cohesive bond strengths.

11. The method of claim 10 wherein the step of applying a third amount of infrared energy to the second surface of the base material comprises the step of applying a third amount of infrared energy unequal to the second amount of infrared energy, so that the base material properties of hardness, yield strength, and tensile strength adjacent the first and second surfaces are different subsequent to quenching.

12. The method of claim 10 comprising the further step of controlling the first and second sources of infrared energy to apply unequal second and third amounts of infrared energy, respectively, so that the base material properties of hardness, yield strength, and tensile strength adjacent the first and second surfaces are different subsequent to quenching.

13. The method of claim 10 wherein the step of applying the first amount of infrared energy comprises the steps of:

a. continuously applying infrared energy in a heat-up phase for the coating of a first predetermined time and heating the coating from an ambient temperature to the first temperature; and b. continuously applying infrared energy in a fusing phase of a second predetermined time for the coating without interruption subsequent to the heat-up phase and maintaining the coating at substantially the first temperature during the fusing phase.

14. The method of claim 13 wherein:

a. the step of continuously applying infrared energy in a heat-up phase for the coating comprises the step of continuously applying infrared energy in a heat-up phase for the base material adjacent the first surface thereof during the first predetermined time and heating the base material adjacent the first surface thereof from the ambient temperature to the second temperature; and b. the step of continuously applying infrared energy in the fusing phase for the coating comprises the step of continuously applying infrared energy in a heat treating phase for the base material adjacent the first surface thereof during the second predetermined time during which time austenite forms in the base material adjacent the first surface thereof.

15. The method of claim 10 wherein the step of applying the second amount of infrared energy comprises the step of continuously applying the second amount of infrared energy without interruption subsequent to applying the first amount of infrared energy for a third predetermined time and maintaining the base material adjacent the first surface thereof at substantially the second temperature during the third predetermined time, so that austenite continues to form in the base material adjacent the first surface thereof during the third predetermined time.

16. The method of claim 10 wherein:

a. the step of applying the second amount of infrared energy comprises the step of applying the second amount of infrared energy for a third predetermined time and maintaining the base material adjacent the first surface thereof at substantially the second temperature during the third predetermined time and thereby continuing to form austenite in the base material adjacent the first surface thereof during the third predetermined time; and b. the step of simultaneously applying a third amount of infrared energy comprises the step of applying the third amount of infrared energy for a fourth predetermined time and maintaining the base material adjacent the second surface thereof at substantially the third temperature during the fourth predetermined time and thereby continuing to form austenite in the base material adjacent the second surface thereof during the fourth predetermined time.

17. The method of claim 16 wherein the step of applying the third amount of infrared energy for a fourth predetermined time comprises the step of applying the third amount of infrared energy for a fourth predetermined time that is substantially equal to the third predetermined time.

18. The method of claim 10 wherein the step of heating the base material adjacent the second surface thereof to a third temperature comprises the step of heating the base material adjacent the second surface thereof to a third temperature that is substantially equal to the second temperature.

19. The method of claim 10 comprising the further step of reheating the composite part with infrared energy to a selected temperature less than the second temperature for a selected time after quenching and thereby tempering or stress relieving the base material.

20. The method of claim 10 comprising the further step of interposing a mask between the first source of the infrared energy and a selected portion of the composite part prior to applying the first amount of infrared energy and thereby shielding the selected portion of the composite part from the infrared energy.

* * * * *